US007076945B2

(12) United States Patent
Sisken et al.

(10) Patent No.: US 7,076,945 B2
(45) Date of Patent: Jul. 18, 2006

(54) METHOD AND SYSTEM FOR CONTROLLING TEMPERATURES OF EXHAUST GASES EMITTED FROM AN INTERNAL COMBUSTION ENGINE TO FACILITATE REGENERATION OF A PARTICULATE FILTER

(75) Inventors: Kevin Dean Sisken, Saline, MI (US); Zornitza Pavlinova Pavlova-MacKinnon, Farmington Hills, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 11/020,839

(22) Filed: Dec. 22, 2004

(65) Prior Publication Data

US 2006/0130466 A1 Jun. 22, 2006

(51) Int. Cl.
*F01N 3/00* (2006.01)

(52) U.S. Cl. ..... 60/295; 60/274; 60/285; 60/297; 60/300; 60/311

(58) Field of Classification Search ..... 60/274, 60/286, 295, 297, 303, 311, 285, 300
See application file for complete search history.

(56) References Cited

U.S. PATENT DOCUMENTS 4,677,823 A 7/1987 Hardy
4,719,751 A 1/1988 Kume et al.
4,730,455 A 3/1988 Pischinger et al.
4,747,264 A 5/1988 Santiago et al.
4,765,284 A * 8/1988 Kanazawa et al. ..... 123/41.49
4,897,096 A 1/1990 Pischinger et al.
5,028,405 A 7/1991 Erdmannsdoerfer et al.
5,042,248 A 8/1991 Abthoff et al.
5,044,158 A 9/1991 Goerlich
5,557,923 A 9/1996 Bolt et al.
5,561,243 A * 10/1996 Machida ..... 73/118.1
5,826,425 A 10/1998 Sebastiano et al.
5,956,944 A 9/1999 Dementhon et al.
6,176,896 B1 1/2001 Dementhon et al.
6,304,815 B1 10/2001 Moraal et al.
6,347,513 B1 2/2002 Pfleger et al.
6,349,707 B1 2/2002 Neumann et al.
6,374,812 B1 4/2002 Wiese
6,397,584 B1 6/2002 Salvat et al.
6,422,001 B1 * 7/2002 Sherman et al. ..... 60/274
6,574,956 B1 6/2003 Moraal et al.
6,594,990 B1 * 7/2003 Kuenstler et al. ..... 60/295
6,615,577 B1 9/2003 Meyer et al.
6,615,580 B1 9/2003 Khair et al.
6,622,480 B1 9/2003 Tashiro et al.
6,632,764 B1 10/2003 Druckhammer et al.
6,666,020 B1 12/2003 Tonetti et al.
6,698,192 B1 3/2004 Ootake
6,708,487 B1 3/2004 Morimoto et al.

(Continued)

FOREIGN PATENT DOCUMENTS

EP 1 197 643 A1 4/2002

*Primary Examiner*—Thomas Denion
*Assistant Examiner*—Diem Tran
(74) *Attorney, Agent, or Firm*—Broosk Kushman P.C.

(57) ABSTRACT

Method, system, and controller for increasing exhaust gas temperatures through controlled operation of a radiator fan in order to facilitate regeneration of a particulate filter. The method, system, and controller being applicable in systems having an engine which emits exhaust gases having particulates which are captured by the particulate filter.

15 Claims, 1 Drawing Sheet

U.S. PATENT DOCUMENTS 6,722,120 B1 4/2004 Plote
6,735,941 B1 5/2004 Saito et al.
6,742,328 B1 6/2004 Webb et al.
6,742,331 B1 6/2004 Minami
6,756,904 B1 6/2004 Kinugawa et al.
6,758,039 B1 7/2004 Kuboshima et al.
6,769,246 B1 8/2004 Strohmaier et al.
6,865,883 B1 * 3/2005 Gomulka ..... 60/295
2001/0010152 A1 8/2001 Tallec et al.
2002/0033017 A1 3/2002 Bruggemann et al.
2002/0112472 A1 8/2002 Tashiro et al.
2002/0128146 A1 9/2002 Druckhammer et al.
2002/0157383 A1 10/2002 Bouchez et al.
2002/0178922 A1 12/2002 Ohno et al.
2002/0189235 A1 12/2002 Meyer et al.
2002/0194843 A1 12/2002 Ootake
2003/0029427 A1 2/2003 Esteghlal
2003/0033800 A1 2/2003 Tonetti et al.
2003/0089102 A1 5/2003 Colignon et al.
2003/0089103 A1 5/2003 Hahn et al.
2003/0106303 A1 6/2003 Plote
2003/0106308 A1 6/2003 Gabe et al.
2003/0115858 A1 6/2003 Hahn et al.
2003/0124031 A1 7/2003 Dionnet et al.
2003/0126858 A1 7/2003 Strohmaier et al.
2003/0136117 A1 7/2003 Megas
2003/0140623 A1 7/2003 Ootake
2003/0145581 A1 8/2003 Tashiro et al.
2003/0145582 A1 8/2003 Bunting et al.
2003/0182936 A1 10/2003 Kitahara
2003/0188518 A1 10/2003 Itoyama et al.
2003/0188527 A1 10/2003 Patterson et al.
2003/0200745 A1 10/2003 van Nieuwstadt et al
2003/0200746 A1 10/2003 Saito et al.
2003/0209010 A1 11/2003 Arnold
2003/0213235 A1 11/2003 Kitahara et al.
2003/0221421 A1 12/2003 Gui et al.
2003/0221423 A1 12/2003 Kosaka et al.
2003/0230060 A1 12/2003 Yahata et al.
2003/0230076 A1 12/2003 Kwon
2003/0230077 A1 12/2003 Kuboshima et al.
2003/0230078 A1 12/2003 Yahata et al.
2003/0230079 A1 12/2003 Kuboshima et al.
2004/0000139 A1 1/2004 Kawashima et al.
2004/0011030 A1 1/2004 Braun et al.
2004/0020194 A1 2/2004 Nishimura et al.
2004/0031262 A1 2/2004 Gui et al.
2004/0055279 A1 3/2004 Plote et al.
2004/0074225 A1 4/2004 Schaller et al.
2004/0098977 A1 5/2004 Kupe et al.
2004/0098979 A1 5/2004 Hammerle et al.
2004/0103648 A1 6/2004 Opris et al.
2004/0103654 A1 6/2004 Ohtake et al.
2004/0134187 A1 7/2004 Inoue et al.
2004/0139729 A1 7/2004 Taylor, III et al.
2004/0139733 A1 7/2004 Koga et al.
2004/0144069 A1 7/2004 Gabe et al.
2004/0144083 A1 7/2004 Ament
2004/0144087 A1 7/2004 Kondou et al.
2004/0159097 A1 8/2004 Uematsu et al.
2004/0172935 A1 9/2004 Otake et al.

* cited by examiner

METHOD AND SYSTEM FOR CONTROLLING TEMPERATURES OF EXHAUST GASES EMITTED FROM AN INTERNAL COMBUSTION ENGINE TO FACILITATE REGENERATION OF A PARTICULATE FILTER

BACKGROUND OF THE INVENTION

1. Field of the Invention

The present invention relates to systems and methods of controlling temperatures of exhaust gases emitted from an internal combustion engine to facilitate regeneration of a particulate filter.

2. Background Art

A particulate filter is a device for capturing particulates emitted in exhaust gases from a combustion engine. In some systems employing a particulate filter, it may be desired to oxidize or burn the capture particulates in a process commonly referred to as regeneration. The regeneration of the particulates is dependent on temperatures at the particulate filter, which may be influence by exhaust gas temperatures.

Accordingly, a need exists to control exhaust gas temperatures at the particulate filter so as to facilitate regeneration of particulates captured with the particulate filter.

SUMMARY OF THE INVENTION

One non-limiting aspect of the present invention relates to controlling operation of a radiator fan so as to increase load on an engine and exhaust gas temperature emitted therefrom in order to facilitate regeneration of a particulate filter.

In accordance with one non-limiting aspect of the present invention, a controller may be configured to determine a desired increase in exhaust gas temperatures and to control radiator fan operation so as to increase load on the engine and exhaust gas temperatures, thereby facilitating regeneration of the particulate filter.

In accordance with one non-limiting aspect of the present invention, the radiator fan may be controlled or modulated between on and off states and/or at different speed in order to control the load on the engine, and thereby, the exhaust gas temperatures emitted from the engine.

In accordance with one non-limiting aspect of the present invention, the control of the radiator fan may be limited to operating conditions wherein an engine coolant temperature is above a predefined threshold. In accordance with one non-limiting aspect of the present invention, the predefined threshold may be selected to correspond with desired passenger compartment heating demands, such as those determined with a sensor. In this manner, radiator fan operation may be limited to preserve operation of a heating system running off the engine coolant fluid, as the heating system may require coolant fluid temperatures above the predefined threshold in order to meet passenger compartment heating demands.

The above features and advantages, along with other features and advantages of the present invention, are readily apparent from the following detailed description of the invention when taken in connection with the accompanying drawings.

DETAILED DESCRIPTION OF THE PREFERRED EMBODIMENT(S)

Figure 1:
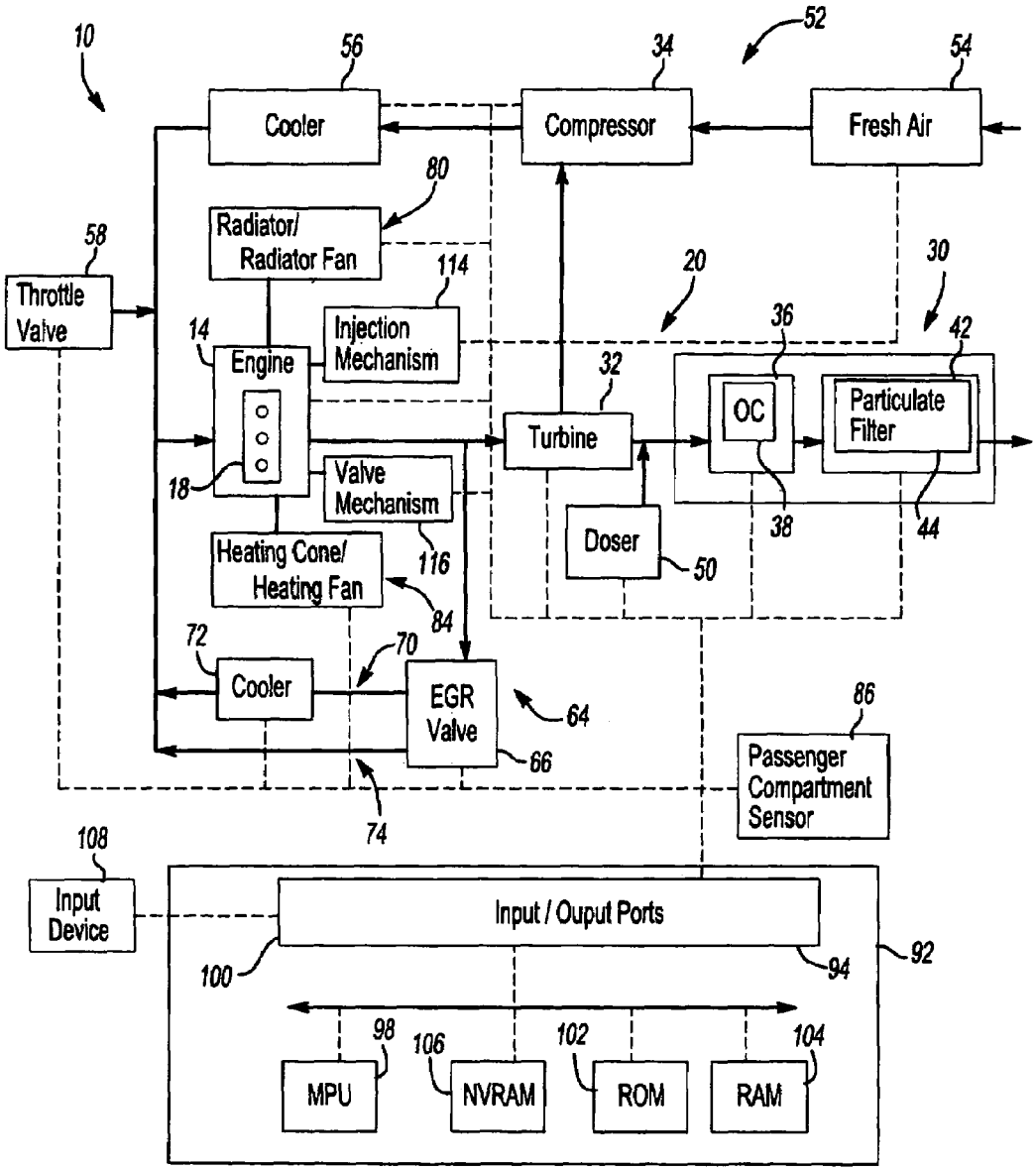
FIG. 1 illustrates a system in accordance with one non-limiting aspect of the present invention.

FIG. 1 illustrates a vehicle powertrain system 10 in accordance with one non-limiting aspect of the present invention. The system 10 may provide power for driving any number of vehicles, including on-highway trucks, construction equipment, marine vessels, stationary generators, automobiles, trucks, tractor-trailers, boats, recreational vehicle, light and heavy-duty work vehicles, and the like.

The system 10 may be referred to as an internal combustion driven system wherein fuels, such as gasoline and diesel fuels, are burned in a combustion process to provide power, such as with an spark or compression ignition engine 14. The engine 14 may be a diesel engine that includes a number of cylinders 18 into which fuel and air are injected for ignition as one skilled in the art will appreciate. The engine 14 may be a multi-cylinder compression ignition internal combustion engine, such as a 4, 6, 8, 12, 16, or 24 cylinder diesel engines, for example. It should be noted, however, that the present invention is not limited to a particular type of engine or fuel.

Exhaust gases generated by the engine 14 during combustion may be emitted through an exhaust system 20. The exhaust system 20 may include any number of features, including an exhaust manifold and passageways to deliver the emitted exhaust gases to a particulate filter assembly 30, which in the case of diesel engines is commonly referred to as a diesel particulate filter. Optionally, the system 20 may include a turbocharger proximate the exhaust manifold for compressing fresh air delivery into the engine 14. The turbocharger, for example, may include a turbine 32 and a compressor 34, such as a variable geometry turbocharger (VGT) and/or a turbocompound power turbine. Of course, the present invention is not limited to exhaust systems having turbochargers or the like.

The particulate filter assembly 30 may be configured to capture particulates associated with the combustion process. In more detail, the particulate filter assembly 30 may include an oxidation catalyst (OC) canister 36, which in includes an OC 38, and a particulate filter canister 42, which includes a particulate filter 44. The canisters 36, 42 may be separate components joined together with a clamp or other feature such that the canisters 36, 42 may be separated for servicing and other operations. Of course, the present invention is not intended to be limited to this exemplary configuration for the particulate filter assembly 30. Rather, the present invention contemplates the particulate filter assembly including more or less of these components and features. In particular, the present invention contemplates the particulate filter assembly 30 including only the particulate filter 44 and not necessarily the OC canister 36 or substrate 38 and that the particulate filter 44 may be located in other portions of the exhaust system 20, such as upstream of the turbine 32.

The OC 38, which for diesel engines is commonly referred to as a diesel oxidation catalyst, may oxidize hydrocarbons and carbon monoxide included within the exhaust gases so as to increase temperatures at the particulate filter 44. The particulate filter 44 may capture particulates included within the exhaust gases, such as carbon, oil particles, ash, and the like, and regenerate the captured particulates if temperatures associated therewith are sufficiently high. In accordance with one non-limiting aspect of the present invention, one object of the particulate filter assembly 30 is to capture harmful carbonaceous particles included in the exhaust gases and to store these contaminates until temperatures at the particulate filter 44 favor oxidation of the captured particulates into a gas that can be discharged to the atmosphere.

The OC and particulate filter canisters 36, 42 may include inlets and outlets having defined cross-sectional areas with expansive portions therebetween to store the OC 38 and particulate filter 44, respectively. However, the present invention contemplates that the canisters 36, 42 and devices therein may include any number configurations and arrangements for oxidizing emissions and capturing particulates. As such, the present invention is not intended to be limited to any particular configuration for the particulate filter assembly 30.

To facilitate oxidizing the capture particulates, a doser 50 may be included to introduce fuel to the exhaust gases such that the fuel reacts with the OC 38 and combusts to increase temperatures at the particulate filter 44, such as to facilitate regeneration. For example, one non-limiting aspect of the present invention contemplates controlling the amount of fuel injected from the doser as a function of temperatures at the particulate filter 44 and other system parameters, such as air mass flow, EGR temperatures, and the like, so as to control regeneration. However, the present invention also contemplates that fuel may be included within the exhaust gases through other measures, such as by controlling the engine 14 to emit fuel with the exhaust gases.

An air intake system 52 may be included for delivering fresh air from a fresh air inlet 54 through an air passage to an intake manifold for introduction to the engine 14. In addition, the system 52 may include an air cooler or charge air cooler 56 to cool the fresh air after it is compressed by the compressor 34. Optionally, a throttle intake valve 58 may be provided to control the flow of fresh air to the engine 14. The throttle valve 58 may be a manually or electrically operated valve, such as one which is responsive to a pedal position of a throttle pedal operated by a driver of the vehicle. There are many variations possible for such an air intake system and the present invention is not intended to be limited to any particular arrangement. Rather, the present invention contemplates any number of features and devices for providing fresh air to the intake manifold and cylinders, including more or less of the foregoing features.

An exhaust gas recirculation (EGR) system 64 may be optionally provided to recycle exhaust gas to the engine 14 for mixture with the fresh air. The EGR system 64 may selectively introduce a metered portion of the exhaust gasses into the engine 14. The EGR system 64, for example, may dilute the incoming fuel charge and lower peak combustion temperatures to reduce the amount of oxides of nitrogen produced during combustion. The amount of exhaust gas to be recirculated may be controlled by controlling an EGR valve 66 and/or in combination with other features, such as the turbocharger. The EGR valve 66 may be a variable flow valve that is electronically controlled. There are many possible configurations for the controllable EGR valve 66 and embodiments of the present invention are not limited to any particular structure for the EGR valve 66.

The EGR system 64 in one non-limiting aspect of the present invention may include an EGR cooler passage 70, which includes an air cooler 72, and an EGR non-cooler bypass 74. The EGR value 66 may be provided at the exhaust manifold to meter exhaust gas through one or both of the EGR cooler passage 70 and bypass 74. Of course, the present invention contemplates that the EGR system 64 may include more or less of these features and other features for recycling exhaust gas. Accordingly, the present invention is not intended to be limited to any one EGR system and contemplates the use of other such systems, including more or less of these features, such as an EGR system having only one of the EGR cooler passage or bypass.

A cooling system 80 may be included for cycling the engine 14 by cycling coolant therethrough. The coolant may be sufficient for fluidly conducting away heat generated by the engine 14, such as through a radiator. The radiator may include a number of fins through which the coolant flows to be cooled by air flow through an engine housing and/or generated by a radiator fan directed thereto as one skilled in the art will appreciated. It is contemplated, however, that the present invention may include more or less of these features in the cooling system 80 and the present invention is not intended to be limited to the exemplary cooling system described above.

The cooling system 80 invention may operate in conjunction with a heating system 84. The heating system 84 may include a heating cone, a heating fan, and a heater valve. The heating cone may receive heated coolant fluid from the engine 14 through the heater valve so that the heating fan, which may be electrically controllable by occupants in a passenger area or cab of a vehicle, may blow air warmed by the heating cone to the passengers. For example, the heating fan may be controllable at various speeds to control an amount of warmed air blown past the heating cone whereby the warmed air may then be distributed through a venting system to the occupants. Optionally, sensors and switches 86 may be included in the passenger area to control the heating demands of the occupants. The switches and sensors may include dial or digital switches for requesting heating and sensors for determining whether the requested heating demand was met. The present invention contemplates that more or less of these features may be included in the heating system and is not intended to be limited to the exemplary heating system described above.

A controller 92, such as an electronic control module or engine control module, may be included in the system 10 to control various operations of the engine 14 and other system or subsystems associated therewith, such as the sensors in the exhaust, EGR, and intake systems. Various sensors may be in electrical communication with the controller via input/output ports 94. The controller 92 may include a microprocessor unit (MPU) 98 in communication with various computer readable storage media via a data and control bus 100. The computer readable storage media may include any of a number of known devices which function as read only memory 102, random access memory 104, and non-volatile random access memory 106. A data, diagnostics, and programming input and output device 108 may also be selectively connected to the controller via a plug to exchange various information therebetween. The device 108 may be used to change values within the computer readable storage media, such as configuration settings, calibration variables, instructions for EGR, intake, and exhaust systems control and others.

The system 10 may include an injection mechanism 114 for controlling fuel and/or air injection for the cylinders 18. The injection mechanism 114 may be controlled by the controller 92 or other controller and comprise any number of features, including features for injecting fuel and/or air into a common-rail cylinder intake and a unit that injects fuel and/or air into each cylinder individually. For example, the injection mechanism 114 may separately and independently control the fuel and/or air injected into each cylinder such that each cylinder may be separately and independently controlled to receive varying amounts of fuel and/or air or no fuel and/or air at all. Of course, the present invention contemplates that the injection mechanism 114 may include more or less of these features and is not intended to be limited to the features described above.

The system 10 may include a valve mechanism 116 for controlling valve timing of the cylinders 18, such as to control air flow into and exhaust flow out of the cylinders 18. The valve mechanism 116 may be controlled by the controller 92 or other controller and comprise any number of features, including features for selectively and independently opening and closing cylinder intake and/or exhaust valves. For example, the valve mechanism 116 may independently control the exhaust valve timing of each cylinder such that the exhaust and/or intake valves may be independently opened and closed at controllable intervals, such as with a compression brake. Of course, the present invention contemplates that the valve mechanism may include more or less of these features and is not intended to be limited to the features described above.

In operation, the controller 92 receives signals from various engine/vehicle sensors and executes control logic embedded in hardware and/or software to control the system 10. The computer readable storage media may, for example, include instructions stored thereon that are executable by the controller 92 to perform methods of controlling all features and sub-systems in the system 10. The program instructions may be executed by the controller in the MPU 98 to control the various systems and subsystems of the engine and/or vehicle through the input/output ports 94. In general, the dashed lines shown in FIG. 1 illustrate the optional sensing and control communication between the controller and the various components in the powertrain system. Furthermore, it is appreciated that any number of sensors and features may be associated with each feature in the system for monitoring and controlling the operation thereof.

In one non-limiting aspect of the present invention, the controller 92 may be the DDEC controller available from Detroit Diesel Corporation, Detroit, Mich. Various other features of this controller are described in detail in a number of U.S. patents assigned to Detroit Diesel Corporation. Further, the controller may include any of a number of programming and processing techniques or strategies to control any feature in the system 10. Moreover, the present invention contemplates that the system may include more than one controller, such as separate controllers for controlling system or sub-systems, including an exhaust system controller to control exhaust gas temperatures, mass flow rates, and other features associated therewith. In addition, these controllers may include other controllers besides the DDEC controller described above.

In accordance with one non-limiting aspect of the present invention, the controller 44 or other feature, such as regeneration system controller, may be configured for determining a desired exhaust gas temperature for the exhaust gases emitted from the engine to facilitate regeneration of the particulate filter whereby particulates captured by the particulate filter are oxidized or otherwise burned. The disposal of the particulates in this manner may be advantageous to prevent clogging and filling of the particulate filter so that the exhaust gases may pass therethrough with minimal restriction and yet permit additional particulates to be collected.

The desired exhaust gas temperature may be calculated to correspond with other factors and influences on the regeneration process. For the purposes of the present invention, the desired exhaust gas temperature is intended to refer to the temperature of exhaust gases emitted from the engine that may be used alone or in combination with other control features to facilitate regeneration, such as in combination with the temperature influence of the doser 50 if the system includes such a feature.

One non-limiting aspect of the present invention relates to controlling the engine 14 to emit exhaust gases at the desired exhaust gas temperature to facilitate regeneration. The control thereof may be instigated according to software included on the controller 44 or inputted thereto. Similarly, however, the control may be executed with other logic and other controllers, such as a regeneration system controller or the like.

In accordance with one non-limiting aspect of the present invention, the desired exhaust temperatures may be determined to correspond with exhaust gas temperatures that are greater than exhaust gas temperatures currently being produced by the engine. For example, the vehicle may be idling or in other relatively low engine load conditions whereby the load on the engine 14 is insufficient to generate exhaust gas temperatures at temperatures high enough to facilitate regeneration of the particulate filter 44. The present invention contemplates this problem and proposes increasing the load on the engine 14 so as to increase the exhaust gas temperature of the exhaust gases emitted therefrom. The increased load may be determined as a function of the desired exhaust gas temperature and the current exhaust gas temperature (which is less that the desired exhaust gas temperature).

In accordance with one non-limiting aspect of the present invention, the exhaust gas temperature is increased to meet the desired exhaust gas temperatures by controlling the radiator fan to operate as a function of the desired exhaust gas temperature so as to increase the load on the engine 14 and thereby increase the temperature of the exhaust gases emitted therefrom.

The control of the radiator fan may include controlling a speed of the fan, such as by controlling a radiator fan clutch. The control of the radiator fan may be provided by the controller 92 or other feature providing control signals thereto. Moreover, the fan may be modulated between different speeds and/or between on and off states to vary the loads on the engine 14 and thereby the exhaust gas temperatures emitted therefrom, such as to control the temperature of the exhaust gases within a predefined temperature range and/or to compensate for changes in engine operations, such as those associated with different driving conditions.

In accordance with one non-limiting aspect of the present invention, the fan clutch may be fixed such that each revolution of the engine operates the fan at a fixed speed. In this manner, the fixed fan clutch may be controlled with control signals to modulate the fan between on and off states to control the exhaust gas temperatures and the rate at which the exhaust gas temperatures increase. In accordance with one non-limiting aspect of the present invention, the fan clutch may be variable such that each revolution of the engine provides variable fan speeds, such as by controlling a gear ratio between the engine and the fan clutch. In this manner, the variable fan clutch may be controlled with control signals to modulate the fan between on and off states and/or at variable speeds to control the exhaust gas temperatures and the rate at which the exhaust gas temperatures increase.

In accordance with one non-limiting aspect of the present invention, the operation of the radiator fan to increase loads on the engine may be adjusted according to engine coolant temperatures. For example, the operation of the radiator fan may be controlled as a function of engine coolant fluid temperatures so as to insure the engine coolant fluid temperature remains above a predefined threshold. Controlling operation of the radiator fan in this manner may be advantageous to insure that the engine coolant fluid temperatures, which may be cooled by operation of the fan if the coolant is recycled through the radiator and/or by air flow generated through the engine compartment in the absence of coolant fluid flow through the radiator, is sufficient to heat the heating core and thereby heat the passenger compartment to meet passenger compartment heating demands.

In accordance with one non-limiting aspect of the present invention, the passenger compartment sensors 86 may be used to determine heating demands of the passenger compartment such that a minimum engine coolant fluid temperature may be selected as a function of the passenger compartment heating demands, which typically requires engine coolant fluid temperatures of at least 130° F. This may be advantageous to insure the engine coolant temperatures are sufficient for heating the heater core in a manner sufficient for the heating fan to meet the heating demands of a passenger compartment.

In accordance with one aspect of the present invention, the operation of the radiator fan as a function of engine coolant temperature and passenger compartment heating demands may be integrated with operation of a thermostat (not shown) if the cooling system includes such a feature. Because the thermostat prohibits the flow of engine coolant fluid to the radiator if engine coolant fluid temperatures are below a higher temperature threshold, such as 180° F., coolant fluid is not cycled through the radiator, which limits the cooling effect of radiator fan operation on the coolant fluid. In such system, however, the radiator fan may be controlled as a function of coolant fluid temperature if the air flow generated in the engine compartment by operation of the radiator fan acts to cool the coolant fluid even though no coolant fluid is flowing to the radiator. In addition, if the thermostat is open, the present invention contemplates operating the radiator fan independently of coolant fluid temperature as the coolant fluid temperature is unlikely to fall below the minimum coolant fluid temperature required for meeting the passenger compartment temperature demands.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for controlling temperatures of exhaust gases emitted from an internal combustion engine to facilitate regeneration of particulates captured with a particulate filter, the internal combustion engine having a number of cylinders for internal combustion which emit exhaust gases and the particulate filter being in fluid communication with the emitted exhaust gases to capture particulates, the method comprising:

determining a desired increase in exhaust gas temperature relative to current exhaust gas temperatures, the desired increase in exhaust gas temperature corresponding with a need to increase exhaust gas temperatures in order to facilitate regenerate of the particulate filter; and operating a radiator fan as a function of the desired increase in exhaust gas temperature to increase load on the engine and thereby exhaust gas temperature so as to emit exhaust gases from the engine to meet the desired increase in exhaust gas temperature;

controlling a radiator fan speed to control a rate at which the exhaust gas temperatures increase; and wherein the fan clutch is variable such that the fan speed may be controlled at variable speeds and the rate at which the exhaust gas temperatures increase is controlled by varying the fan speed.

2. The method of claim 1 further comprising determining the desired increase in exhaust gas temperature as a function of exhaust gas temperature at a particulate filter doser, the particulate filter doser being located upstream from the particulate filter and configured for introducing fuel to the exhaust gases to facilitate regeneration of the particulate filter.

3. The method of claim 1 further comprising determining the desired increase in exhaust gas temperature as a function of exhaust gas temperature at an oxidation catalyst (OC), the OC being located upstream from the particulate filter and configured for fuel in the exhaust gases to facilitate regeneration of the particulate filter.

4. The method of claim 1 wherein the variable fan clutch provides variable speeds according to a clutch ratio, and wherein the method further comprises controlling the clutch ratio to control the fan speed.

5. The method of claim 1 wherein the fan clutch is fixed such that the fan speed is fixed and the rate at which the exhaust gas temperatures increase is controlled by modulating the fan on and off at the fixed speed.

6. The method of claim 1 further comprising modulating fan operation after achieving the desired increase in exhaust gas temperature to maintain the temperature of the emitted exhaust gases within a predefined temperature range to facilitate regeneration.

7. The method of claim 6 further comprising modulating fan speed to maintain the temperature of the emitted exhaust gases within the predefined temperature range to facilitate regeneration.

8. A method for controlling temperatures of exhaust gases emitted from an internal combustion engine to facilitate regeneration of particulates captured with a particulate filter, the internal combustion engine having a number of cylinders for internal combustion which emit exhaust gases and the particulate a filter being in fluid communication with the emitted exhaust gases to capture particulates, the method comprising:

determining a desired increase in exhaust gas temperature relative to current exhaust gas temperatures, the desired increase in exhaust gas temperature corresponding with a need to increase exhaust gas temperatures in order to facilitate regenerate of the articulate filter; and operating a radiator fan as a function of the desired increase in exhaust gas temperature to increase load on the engine and thereby exhaust gas temperature so as to emit exhaust gases from the engine to meet the desired increase in exhaust gas temperature;

operating the fan only if an engine coolant fluid temperature is above a predefined threshold; and wherein the engine is in a vehicle having a passenger compartment, and wherein the method further comprises selecting the engine coolant fluid temperature threshold as a function of desired passenger compartment temperatures.

9. The method of claim 8 further comprising sensing passenger compartment heating demands with a sensor in the passenger compartment to facilitate selecting the engine coolant temperature threshold.

10. The method of claim 9 further comprising selecting the engine coolant fluid temperature to be at least 130° F.

11. The method of claim 9 further comprising operating the fan independently of engine coolant temperature if a thermostat used to control fluid flow to a radiator is open.

12. A method for controlling temperatures of exhaust gases emitted from an internal combustion engine to facilitate regeneration of particulates captured with a particulate filter, the internal combustion engine having a number of cylinders for internal combustion which emit exhaust gases and the particulate filter being in fluid communication with the emitted exhaust gases to capture particulates, the method comprising:

determining a desired increase in exhaust gas temperature;

operating a radiator fan as a function of the desired increase in exhaust gas temperature to increase load on the engine and thereby exhaust gas temperature so as to emit exhaust gases from the engine to meet the desired increase in exhaust gas temperature if an engine coolant fluid temperature is above a engine coolant temperature threshold; and wherein the engine is in a vehicle having a passenger compartment in communication with a heater which operates off of engine coolant fluid to heat the passenger compartment, and wherein the method further comprises selecting the engine coolant fluid temperature threshold as a function of desired passenger compartment temperatures.

13. The method of claim 12 further comprising selecting the engine coolant temperature fluid threshold as a function of passenger compartment heating demands, the passenger compartment heating demands including heating requests from passengers in the passenger compartment.

14. The method of claim 13 further comprising sensing passenger compartment heating requests with a sensor in the passenger compartment to facilitate selecting the engine coolant temperature threshold.

15. A method for increasing load on a engine to increase exhaust gases emitted from the engine in order to facilitate regeneration of particulates captured with a particulate filter in a vehicle having a passenger compartment, the method comprising:

determining a minimum passenger compartment temperature;

determining a minimum engine coolant fluid temperature for an engine coolant fluid as a function of the minimum passenger compartment temperature;

operating a radiator fan as a function of a desired increase in exhaust gas temperature to increase load on the engine and thereby exhaust gas temperature so as to emit exhaust gases from the engine to meet the desired increase in exhaust gas temperature to facilitate regeneration of the particulate filter, whereby operation of the fan cools the engine coolant fluid; and adjusting the operation of the radiator fan to prevent the engine coolant fluid from cooling below the minimum engine coolant fluid temperature.

* * * * *

UNITED STATES PATENT AND TRADEMARK OFFICE

CERTIFICATE OF CORRECTION

PATENT NO. : 7,076,945 B2
APPLICATION NO. : 11/020839
DATED : July 18, 2006
INVENTOR(S) : Kevin Dean Sisken and Zornitza Pavlinova Pavlova MacKinnon It is certified that error appears in the above-identified patent and that said Letters Patent is hereby corrected as shown below:

Column 7, claim 1, line 62 – delete "regenerate" and insert --regeneration--.

Column 8, claim 8, line 49 – delete "regenerate" and insert --regeneration--.

Signed and Sealed this

Twenty-first Day of November, 2006

JON W. DUDAS
*Director of the United States Patent and Trademark Office*